US008262086B2

(12) United States Patent
Kitazawa

(10) Patent No.: US 8,262,086 B2
(45) Date of Patent: Sep. 11, 2012

(54) SHEET PROCESSING SYSTEM, SHEET PROCESSOR AND ABNORMAL-TRANSPORTATION CORRECTION METHOD

(75) Inventor: Hidehisa Kitazawa, Suzuka (JP)

(73) Assignee: Fuji Xerox Co., Ltd., Tokyo (JP)

( * ) Notice: Subject to any disclaimer, the term of this patent is extended or adjusted under 35 U.S.C. 154(b) by 35 days.

(21) Appl. No.: 12/507,412

(22) Filed: Jul. 22, 2009

(65) Prior Publication Data

US 2010/0019444 A1 Jan. 28, 2010

(30) Foreign Application Priority Data

Jul. 23, 2008 (JP) ..... 2008-189399

(51) Int. Cl.
*B65H 43/04* (2006.01)
*G03G 21/00* (2006.01)

(52) U.S. Cl. ..... 271/215; 271/213; 271/214; 271/292; 399/124; 399/125

(58) Field of Classification Search ..... 271/213–215, 271/217, 292; 399/124, 125
See application file for complete search history.

(56) References Cited

U.S. PATENT DOCUMENTS

| | | | | | |
|---|---|---|---|---|---|
| 4,927,131 | A | * | 5/1990 | Hashimoto et al. | 271/215 |
| 5,121,911 | A | * | 6/1992 | Yamazaki et al. | 270/58.13 |
| 5,192,261 | A | * | 3/1993 | Honjo et al. | 493/29 |
| 5,995,773 | A | * | 11/1999 | Awano | 399/21 |
| 6,112,047 | A | | 8/2000 | Kato et al. | 399/381 |
| 6,134,418 | A | | 10/2000 | Kato et al. | 399/405 |
| 6,171,225 | B1 | * | 1/2001 | Nonoyama et al. | 493/16 |
| 6,263,185 | B1 | | 7/2001 | Kato et al. | 399/381 |
| 6,397,028 | B1 | * | 5/2002 | Nakamura | 399/124 |
| 6,826,374 | B2 | | 11/2004 | Kato et al. | 399/16 |
| 6,986,511 | B2 | * | 1/2006 | Yamada et al. | 271/294 |
| 2003/0044186 | A1 | | 3/2003 | Kato et al. | 399/16 |

FOREIGN PATENT DOCUMENTS

| | | | | |
|---|---|---|---|---|
| JP | 9-301602 | A | | 11/1997 |
| JP | 2000198613 | A | * | 7/2000 |
| JP | 2001-226022 | A | | 8/2001 |
| JP | 2002-265124 | A | | 9/2002 |
| JP | 2003-76085 | | | 3/2003 |
| JP | 2003-76085 | A | | 3/2003 |
| JP | 2004-175530 | | | 6/2004 |
| JP | 3849334 | B2 | | 9/2006 |
| JP | 2009-179408 | A | | 8/2009 |

* cited by examiner

*Primary Examiner* — Luis A Gonzalez
(74) *Attorney, Agent, or Firm* — Morgan, Lewis & Bockius LLP

(57) ABSTRACT

The sheet processing system includes: an image forming unit forming an image on a sheet; a sheet stack unit that lowers along a moving route, as more sheets are stacked on the sheet stack unit, the sheets each having an image formed by the image forming unit and being transported through a first route; a processing unit provided in a housing, and applying processing to a sheet having an image formed by the image forming unit, the sheet being transported through a second route; a cover member provided so that a part of the housing is openable, partially reaching a position in the moving route when the part is opened, and allowing a user to operate the processing unit by opening the part; and a moving unit moving the sheet stack unit to a position where the sheet stack unit does not interfere with the cover member, upon abnormal transportation.

7 Claims, 6 Drawing Sheets

SHEET PROCESSING SYSTEM, SHEET PROCESSOR AND ABNORMAL-TRANSPORTATION CORRECTION METHOD

CROSS REFERENCE TO RELATED APPLICATIONS

This application is based on and claims priority under 35 USC §119 from Japanese Patent Application No. 2008-189399 filed Jul. 23, 2008.

BACKGROUND

1. Technical Field

The present invention relates to a sheet processing system for applying processing to a sheet, a sheet processor, and an abnormal-transportation correction method.

2. Related Art

A finisher including an exit tray elevation unit for facilitating jam processing has been proposed.

SUMMARY

According to an aspect of the present invention, there is provided a sheet processing system including: an image forming unit that forms an image on a sheet; a sheet stack unit that lowers along a moving route set in advance, as more sheets are stacked on the sheet stack unit, the sheets each having an image formed thereon by the image forming unit, the sheets being transported through a first transporting route; a processing unit that is provided in a housing, and that applies processing to a sheet having an image formed thereon by the image forming unit, the sheet being transported through a second transporting route; a cover member that is provided so that a part of the housing is openable, that partially reaches a position in the moving route when the part of the housing is opened, and that allows a user to operate the processing unit by opening the part of the housing; and a moving unit that moves the sheet stack unit to a position where the sheet stack unit does not interfere with the cover member, upon occurrence of an abnormality in transportation of a sheet.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
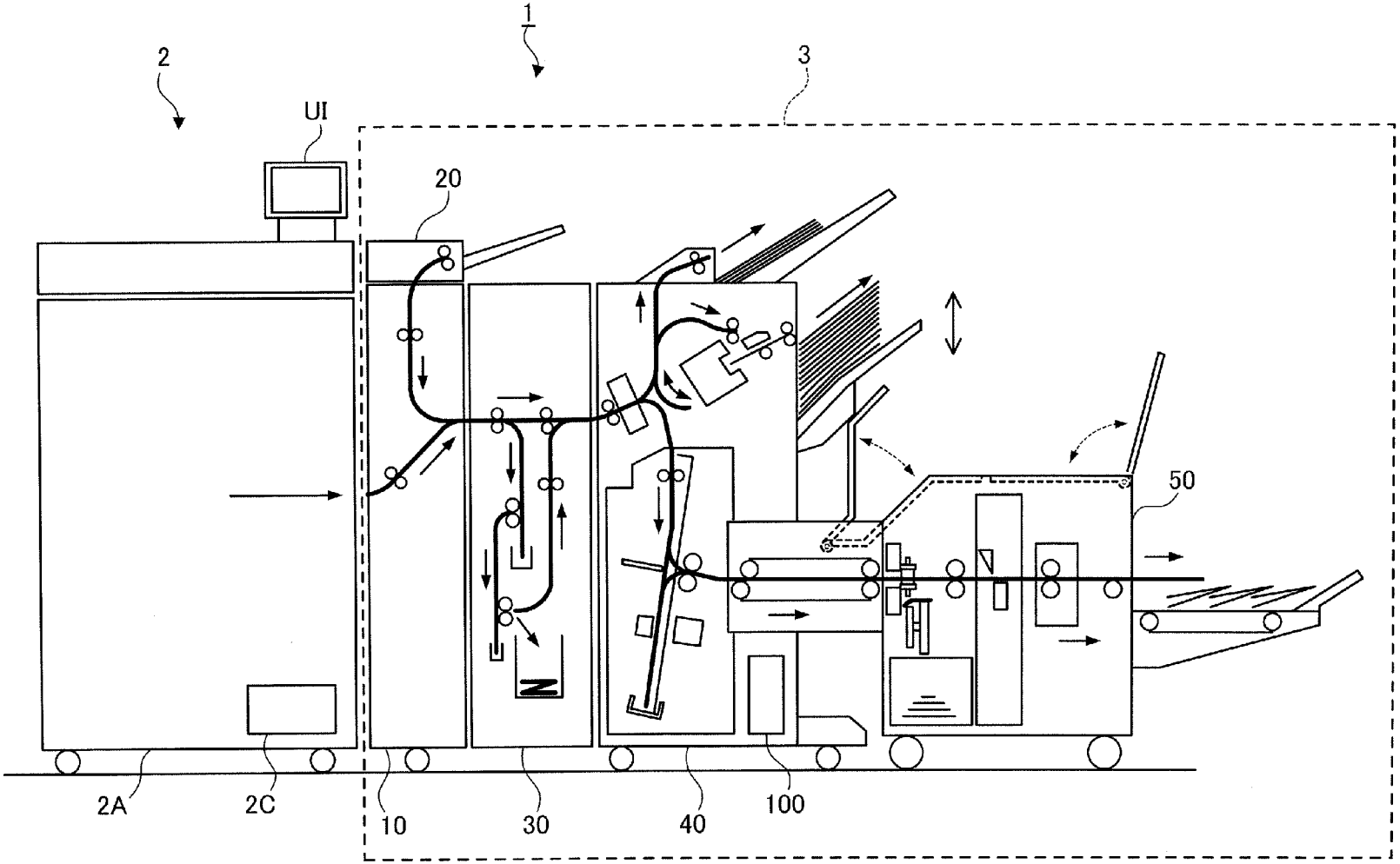
FIG. 1 is an entire configuration of a paper sheet processing system to which the exemplary embodiment is applied.

FIG. 1 is an entire configuration of a paper sheet processing system 1 to which the exemplary embodiment is applied. The paper sheet processing system 1 shown in FIG. 1 includes, for example, an image forming apparatus 2, such as a printer and a copy machine, which forms an image by electrophotography, and a paper sheet processor 3 that applies post-processing to a paper sheet (an example of a sheet) on which, for example, a toner image has been formed by the image forming apparatus 2.

Here, the image forming apparatus 2 includes an image forming apparatus main body 2A, and a user interface (UI) that displays information to an operator (a user) and receives an instruction (an input) from the operator, the UI being formed of, for example, a liquid crystal display. Additionally, the image forming apparatus 2 includes, inside the image forming apparatus main body 2A, an image forming portion (not shown in the figure) that forms, for example, a toner image on a paper sheet. The image forming apparatus 2 further includes a paper sheet transporting mechanism (not shown in the figure) that includes a drive source such as a motor, and transports a paper sheet to the image forming portion, and transports (outputs), to the paper sheet processor 3, a paper sheet on which an image has been formed in the image forming portion. Furthermore, the image forming apparatus 2 includes a controller 2C that controls the image forming portion in the image forming apparatus main body 2A, the paper sheet transporting mechanism, the UI and the like.

On the other hand, the paper sheet processor 3 includes a transporting apparatus 10 that further transports, to the downstream side, a paper sheet outputted from the image forming apparatus 2, and a slip-sheet supplying apparatus 20 that supplies a slip sheet such as a cardboard or a windowed paper sheet to a paper sheet transported by this transporting apparatus 10. Additionally, the paper sheet processor 3 includes a folding apparatus 30 that applies folding processing, such as twice inward folding (C-folding), twice outward folding (Z-folding), or the like, to the paper sheet transported by the transporting apparatus 10, and a first post-processing apparatus 40 that, while being provided in the downstream side of the folding apparatus 30, applies punching, end binding, or center binding to a paper sheet. Furthermore, the paper sheet processor 3 further includes a second post-processing apparatus 50 that is provided to the downstream side of the first post-processing apparatus 40, and applies additional post-processing to a bundle of center-folded and center-bound paper sheets (a book form). Additionally, the paper sheet processor 3 includes a drive motor and the like that drives portions and units included in the transporting apparatus 10, the slip-sheet supplying apparatus 20, the folding apparatus 30, the first post-processing apparatus 40 and the second post-processing apparatus 50.

Additionally, the paper sheet processor 3 has a controller 100 that is provided so as to be communicable with the controller 2C in the image forming apparatus 2, and controls an entirety of the paper sheet processor 3. Note that, although a position in which the controller 100 is installed is not particularly an issue, the controller 100 is provided in the first post-processing apparatus 40 in the present exemplary embodiment.

Figure 2:
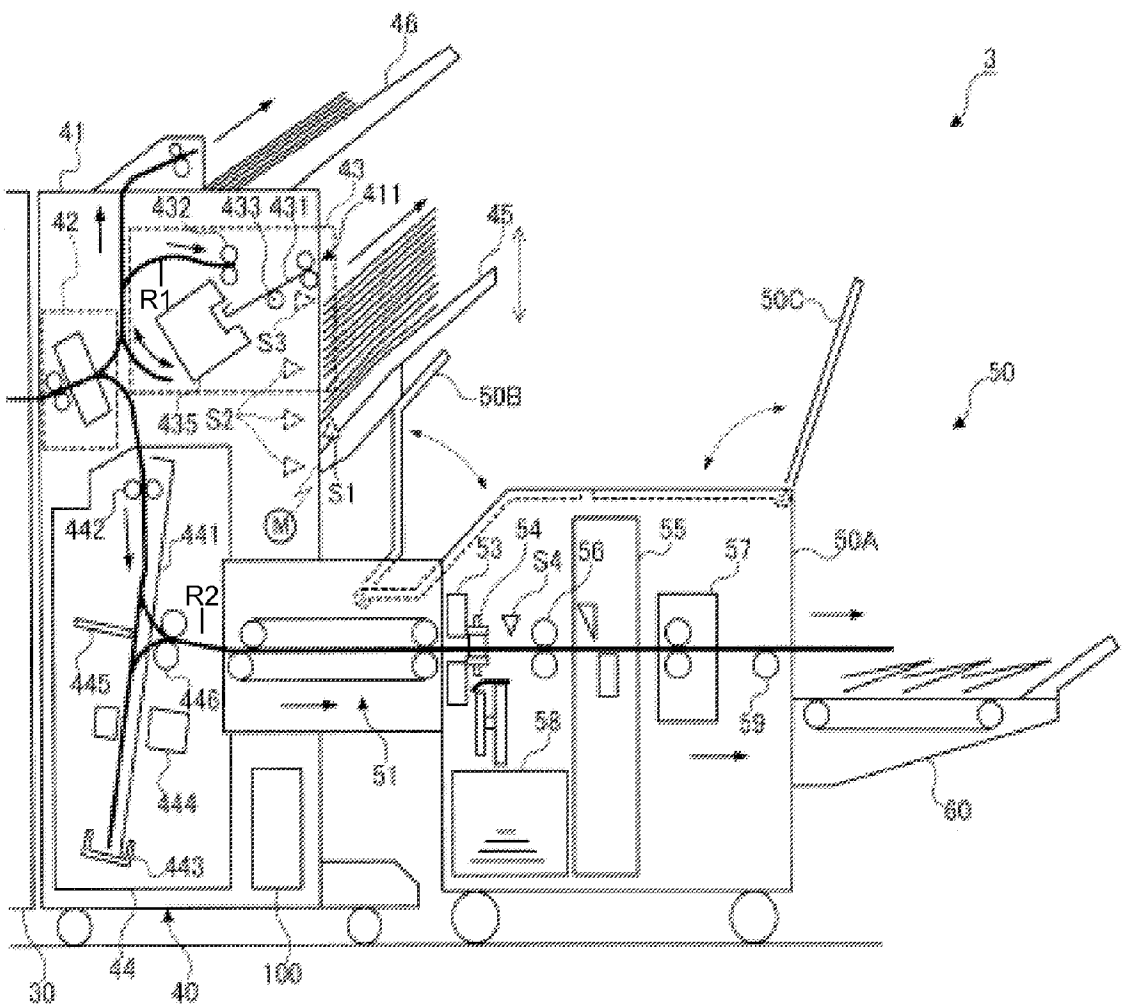
FIG. 2 is an enlarged view showing the first post-processing apparatus and the second post-processing apparatus.

Here, by use of FIG. 2, the first post-processing apparatus 40 and the second post-processing apparatus 50 will be described in detail. FIG. 2 is an enlarged view showing the first post-processing apparatus 40 and the second post-processing apparatus 50.

The first post-processing apparatus 40 includes: an apparatus main body 41 formed substantially into a rectangular parallelepiped shape; a punching unit 42 that applies punching to a paper sheet; and an end binder 43 that binds an end of a paper sheet bundle by using a staple. Additionally, the first post-processing apparatus 40 includes a center-binding unit 44 that center-folds and center-binds a paper sheet bundle to produce a double-page spread booklet. Note that, in each of the first and second post-processing apparatuses 40 and 50, a paper sheet transporting route is configured to branch into two transporting routes after passing through the punching unit 42. Then, while one of the two transporting routes (a first transporting route) is configured to reach an end-bound paper sheet stack unit 45 (described later), the other (a second transporting route) is configured to reach the second post-processing apparatus 50.

Additionally, the first post-processing apparatus 40 includes the plate-like end-bound paper sheet stack unit 45 which is provided so as to be movable on the transporting route along a vertical direction while being provided so as to project from a side face of the apparatus main body 41, and on which bundles of end-bound paper sheets are stacked. This end-bound paper sheet stack unit 45, which functions as a sheet stack unit, is arranged in a slanted state so that one side thereof more distant from the apparatus main body 41 may be positioned higher than the other side closer to the apparatus main body 41. Furthermore, the first post-processing apparatus 40 includes an upper stack unit 46 which is provided on an upper portion of the apparatus main body 41 and on which paper sheets to which no processing is applied by the first post-processing apparatus 40 or paper sheets to which only punching has been applied in the punching unit 42 are stacked.

Additionally, the first post-processing apparatus 40 includes: a motor M used for moving the end-bound paper sheet stack unit 45 in an up or down direction; and a moving mechanism (not shown in the figure) that includes an endless belt and the like, and moves the end-bound paper sheet stack unit 45 in the up or down direction by using drive force from the motor M. Furthermore, the first post-processing apparatus 40 includes a presence/absence detecting sensor S1 that detects presence or absence of a paper sheet on the end-bound paper sheet stack unit 45. Additionally, the first post-processing apparatus 40 includes plural position detecting sensors S2 which are provided along the up and down direction, and detect a position of the end-bound paper sheet stack unit 45 in the up and down direction.

Furthermore, the first post-processing apparatus 40 includes a paper sheet detecting sensor S3 that detects paper sheets stacked on the end-bound paper sheet stack unit 45. Note that, in the present exemplary embodiment, a position of the end-bound paper sheet stack unit 45 is controlled by the controller 100 on the basis of an output from the sheet detecting sensor S3 so that the uppermost one of the paper sheets on the end-bound paper sheet stack unit 45 may be positioned lower than a later-described opening 411. Additionally, in the present exemplary embodiment, a position of the end-bound paper sheet stack unit 45 is controlled by the controller 100 on the basis of an output from the sheet detecting sensor S3 so that the uppermost one of the paper sheets on the end-bound paper sheet stack unit 45 may maintain a constant position. For this reason, in the present exemplary embodiment, the end-bound paper sheet stack unit 45 lowers as more paper sheets are stacked thereon.

The end binder 43 includes: a compiler 431 collecting and receiving plural paper sheets; and exit rolls 432 being a pair of rolls that output a paper sheet toward the compiler 431. Additionally, the end binder 43 includes a main paddle and a sub paddle (which are not shown in the figure) that rotate so as to push a rear end of a paper sheet toward an end guide of the compiler 431. Furthermore, the end binder 43 includes an ejection roll 433 that transports to the end-bound paper sheet stack unit 45, through the opening 411 formed in the apparatus main body 41, a bundle of paper sheets accumulated in the compiler 431. Furthermore, the end binder 43 includes an end-binding stapler 435 used for binding an end of a bundle of paper sheets contained in the compiler 431.

The center-binding unit 44 includes: an accumulating portion 441 that, when a center-folded and center-bound booklet is produced, accumulates the required number of paper sheets on which images have been formed; discharging rolls 442 that output a paper sheet to the accumulating portion 441; and an end guide 443 that moves along the accumulating portion 441 so as to determine center-binding and center-folding positions. Additionally, although illustration of the following is omitted, the center binding unit 44 includes: a paddle that rotates so as to align, toward the end guide 443, paper sheets to be accumulated on the accumulating portion 441; a pair of aligning plates that slide so as to align, in a width direction of the paper sheets, the paper sheets to be accumulated on the accumulating portion 441. Furthermore, the center-binding unit 44 includes a stapler 444 that center-binds a bundle of paper sheets accumulated on the accumulating portion 441.

Furthermore, the center-binding unit 44 includes: a folding knife 445 that moves so as to project from an upper side to a lower side of the accumulating portion 441 for the purpose of folding, at the center-binding position, a bundle of paper sheets having been center-bound by the stapler 444; folding rolls 446 formed of a pair of rolls that sandwich a bundle of paper sheets having started to be folded by the folding knife 445; and a transporting roll (not shown in the figure) that transports, to the second post-processing apparatus 50, a bundle of paper sheets sandwiched by the folding rolls 446.

When a center-folded and center-bound booklet is produced in the first post-processing apparatus 40, the discharging rolls 442 of the center-binding unit 44 sequentially discharges transported paper sheets into the accumulating portion 441. At this time, the end guide 443 moves and stops, for example, so that central parts of the paper sheets may be positioned at a stapling position where the paper sheets are stapled by the stapler 444. Then, the predetermined number of paper sheets is accumulated on the accumulating portion 441, and thereafter, the central parts, for example, of the paper sheets are bound by the stapler 444. Subsequently, a bundle of the center-bound paper sheets is moved by an upward movement of the end guide 443 so that a folded part thereof (for example, the center parts of the paper sheets) may coincide with a tip position of the folding knife 445.

Then, after the folded part of a bundle of the paper sheets moves to the tip position of the folding knife 445, the folding knife 445 is pushed out in a downward direction from the above. Then, a tip of the folding knife 445 is pushed out into a part below an opening of the accumulating portion 441, whereby the paper sheet bundle is pushed down from a containing face of the accumulating portion 441, and comes to be sandwiched by the folding rolls 446. Thereafter, the paper sheet bundle whose center has been bound by the stapler 444 and folded by the folding knife 445 and the folding rolls 446 is transported to the second post-processing apparatus 50 by a transporting roll (not shown in the figure).

Next, the second post-processing apparatus 50 will be described.

The second post-processing apparatus 50 includes an apparatus main body (a housing) 50A formed substantially into a rectangular parallelepiped shape. Additionally, the second post-processing apparatus 50 includes a first cover member 50B and a second cover member 50C. Each of the first and second cover portions 50B and 50C covers an opening formed in an upper portion of the apparatus main body 50A, and opens this upper portion by being provided so as to have an end portion thereof joined to an upper portion of the apparatus main body 50A and so as to be openable and closable with this end portion serving as a supporting point. Here, in the second post-processing apparatus 50 in the present exemplary embodiment, there is a possibility that an abnormality in sheet transportation, such as a jam (a paper sheet jam), may occur in the paper-sheet bundle transporting route, a later-described cutting unit 55 or the like.

In such a case, the paper-sheet bundle transporting route, the cutting unit 55 or the like in the second post-processing apparatus 50 becomes accessible by opening the first and second cover members 50B and 50C. In an additional remark, various members provided to the paper-sheet bundle transporting route, the cutting unit 55 and the like become operable by opening the first and second cover members 50B and 50C. Thereby, a jam becomes removable. Note that the first cover member 50B in the present exemplary embodiment is provided below the end-bound paper sheet stack unit 45 in the first post-processing apparatus 40. The first cover member 50B is provided so that a part thereof (an end portion opposite to the end portion in which the supporting point is provided) may reach a position in the moving route of the end-bound paper sheet stack unit 45 when the first cover member 50B is opened.

Additionally, the second post-processing apparatus 50 includes members and units, which are described below, inside the apparatus main body 50A. To begin with, the second post-processing apparatus 50 includes: a transporting unit 51 that transports a booklet (a paper sheet bundle) whose center has been bound and folded and that adjusts positional misalignment of the booklet. Additionally, the second post-processing apparatus 50 includes: a clamp member 53 that holds a front end portion (a center-folded/center-bound portion) of the booklet by sandwiching the front end portion; and a pressing roll member 54 that moves while pressing the front end portion of the booklet, and thereby flattens the front end portion.

Additionally, the second post-processing apparatus 50 includes: a cutting unit (a trimmer unit) 55 (one example of a processing unit) that performs cutting processing so as to trim a rear end portion (a spread portion) of a booklet; a feeding roll 56 that feeds the booklet into an inside of the cutting unit 55; and a cut position setting unit 57 that moves while sandwiching and holding the booklet so as to determine a cut position of the rear end portion of the booklet. Additionally, the second post-processing apparatus 50 includes: a cutting wastage receiving unit 58 that receives cutting wastage from the booklet cut by the cutting unit 55; and a booklet transporting roll 59 that transports the booklet whose rear end portion has been cut by the cutting unit 55. Furthermore, the second post-processing apparatus 50 includes, along a transporting route of paper sheets (a booklet), plural jam detecting sensors S4 that detect a jam of a booklet (a paper sheet bundle) (FIG. 2 shows only one of the jam detecting sensors S4). Furthermore, the second post-processing apparatus 50 includes a booklet stack unit 60 that accumulates bound booklets, and booklets fed from the booklet transporting roll 59 are accumulated in the booklet stack unit 60 while being sequentially transported one by one.

Incidentally, in the present exemplary embodiment, as has been described above, when a jam occurs in the second post-processing apparatus 50, the jam becomes removable by opening the first cover member 50B and the second cover member 50C. Additionally, in the present exemplary embodiment, as has been mentioned above, the end-bound paper sheet stack unit 45 lowers as more end-bounded paper sheet bundles are stacked on the end-bound paper sheet stack unit 45. Furthermore, the first cover member 50B is provided below the end-bound paper sheet stack unit 45 of the first post-processing apparatus 40, and is provided so that a part thereof may reach a position in the moving route of the end-bound paper sheet stack unit 45. For this reason, when a jam occurs in the second post-processing apparatus 50, if the end-bound paper sheet stack unit 45 is positioned at a lower part (in a lowered state), the end-bound paper sheet stack unit 45 and the first cover member 50B interfere with each other, which hinders the first cover member 50B from being sufficiently opened. As a result, removal of a jam becomes difficult. Consequently, in the present exemplary embodiment, the following processing is applied in which the end-bound paper sheet stack unit 45 is elevated to a position where the end-bound paper sheet stack unit 45 does not interfere with the first cover member 50B.

Here, interference between the end-bound paper sheet stack unit 45 and the first cover member 50B becomes avoidable if the second post-processing apparatus 50 is provided so as to be separated from the first post-processing apparatus 40. In this case, however, an occupied area (an installation area) of the paper sheet processor 3 becomes large. Consequently, in the present exemplary embodiment, the second post-processing apparatus 50 is arranged near the first post-processing apparatus 40. This arrangement allows the occupied area of the paper sheet processor 3 to be small. That is, this arrangement allows the paper sheet processor 3 to be more space saving.

Note that, as the end-bound paper sheet stack unit 45 is arranged in the slanted state as mentioned above, paper sheets on the end-bound paper sheet stack unit 45 are stacked in a state of leaning against the apparatus main body 41. If the end-bound paper sheet stack unit 45 is elevated in this state, the paper sheets on the end-bound paper sheet stack unit 45 may possibly enter the opening 411 in the apparatus main body 41 or be caught by the opening 411, whereby there is a risk of having the paper sheets in a jumbled stacked state, or a risk of damaging the paper sheets. For this reason, in the present exemplary embodiment, on condition that paper sheets on the end-bound paper sheet stack unit 45 have been removed, elevation of the end-bound paper sheet stack unit 45 is executed. Then, the present exemplary embodiment is configured so that occurrence of a jam or necessity of jam removal may be displayed on the UI (refer to FIG. 1) after the elevation of the end-bound paper sheet stack unit 45 is executed.

Figure 3:
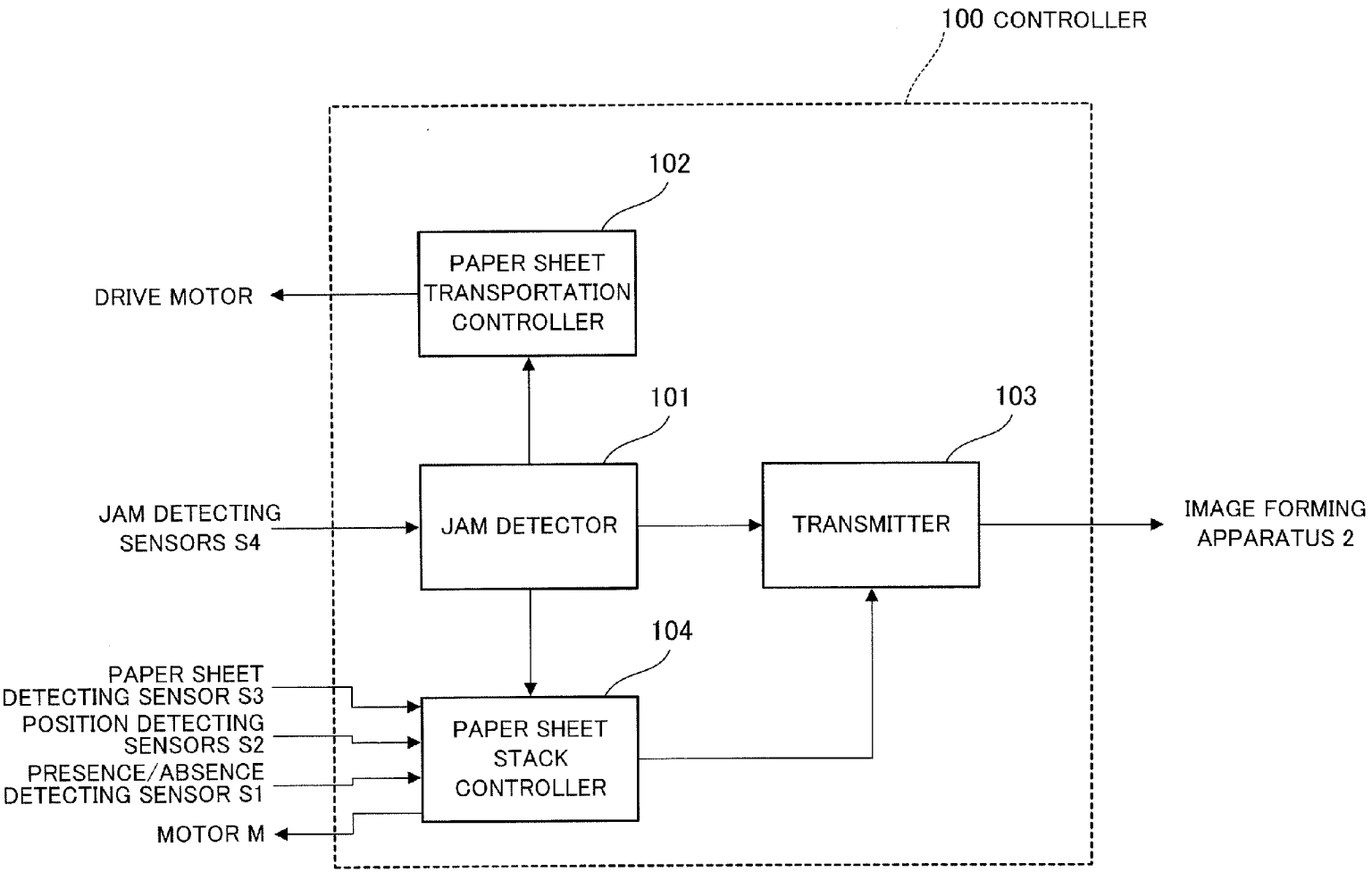
FIG. 3 is a block diagram for explaining a functional configuration of the controller in the paper sheet processor.

Here, FIG. 3 is a block diagram for explaining a functional configuration of the controller 100 in the paper sheet processor 3. Note that FIG. 3 shows only a functional configuration with respect to jam removal.

As shown in this figure, the controller 100 in the present exemplary embodiment includes a jam detector 101, a paper sheet transportation controller 102, a transmitter 103, and a paper sheet stack controller 104.

The jam detector 101 detects occurrence of a jam in the second post-processing apparatus 50 on the basis of outputs from the jam detecting sensors S4. Additionally, the jam detector 101 outputs a detection result on jam occurrence to the paper sheet transportation controller 102, the transmitter 103, and the paper sheet stack controller 104.

The paper sheet transportation controller 102 controls a drive motor (not shown in the figure) or the like, thereby controlling transportation of paper sheets (paper sheet bundles) in the paper sheet processor 3.

The transmitter (a transmitting unit) 103 transmits predetermined information to the image forming apparatus 2 after receiving a detection result in the jam detector 101, and information from the paper sheet stack controller 104.

The paper sheet stack controller 104 identifies a position of the end-bound paper sheet stack unit 45 on the basis of outputs from the position detecting sensors S2. Additionally, the paper sheet stack controller 104 determines whether or not the end-bound paper sheet stack unit 45 is in a lowered state, that is, the end-bound paper sheet stack unit 45 is positioned lower than a predetermined position. Furthermore, on the basis of outputs from the presence/absence detecting sensor S1, the paper sheet stack controller 104, which functions as one example of a detecting unit, determines whether or not paper sheets on the end-bound paper sheet stack unit 45 have been removed. Additionally, the paper sheet stack controller 104, which functions as one example of a moving unit, drives the motor M, thereby elevating and lowering the end-bound paper sheet stack unit 45.

Figure 4:
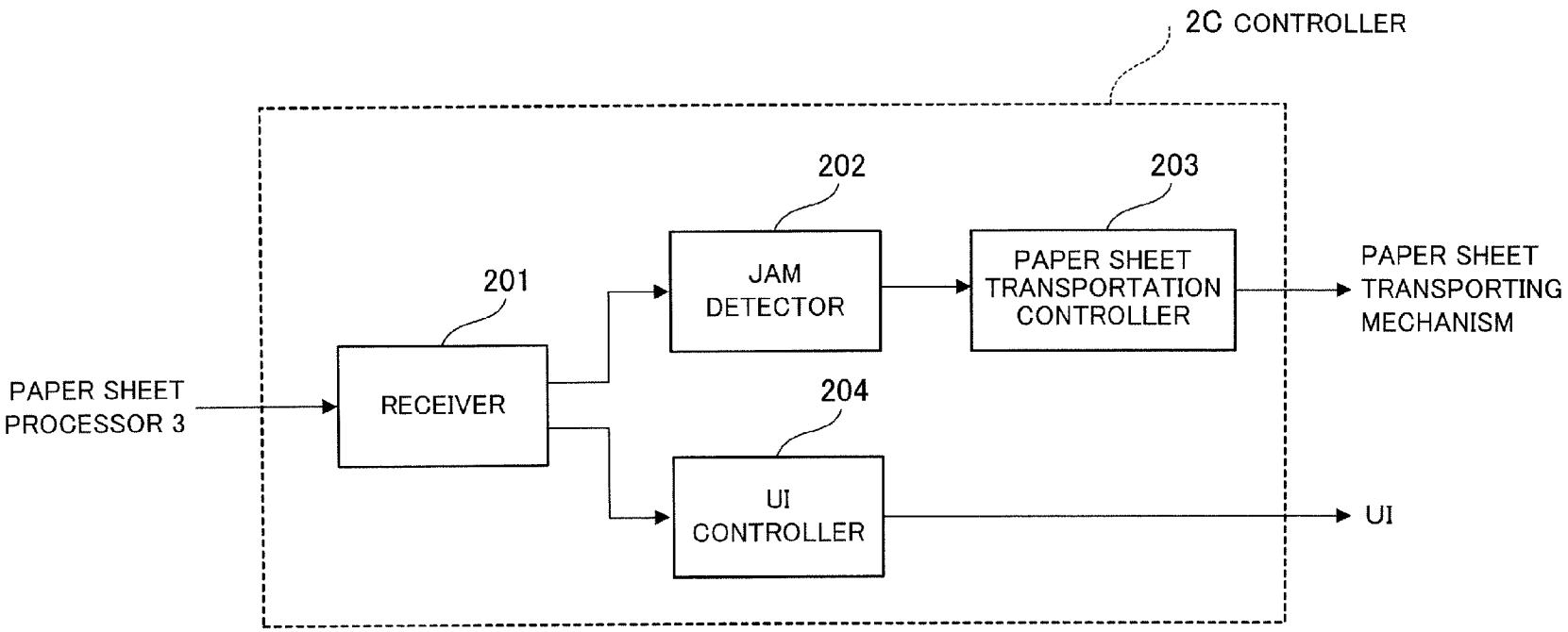
FIG. 4 is a block diagram for explaining a functional configuration of the controller in the image forming apparatus.

Here, FIG. 4 is a block diagram for explaining a functional configuration of the controller 2C in the image forming apparatus 2. Note that this drawing also shows only a functional configuration with respect to the jam removal.

As shown in this drawing, the controller 2C in the present exemplary embodiment includes a receiver 201, a jam detector 202, a paper sheet transportation controller 203 and a UI controller 204.

The receiver 201 receives information transmitted from the controller 100 in the paper sheet processor 3, and outputs this information to the jam detector 202 and the UI controller 204.

The jam detector 202 detects occurrence of a jam in the second post-processing apparatus 50 on the basis of the information outputted from the receiver 201.

The paper sheet transportation controller 203 controls the paper sheet transporting mechanism in the image forming apparatus 2, thereby executing and stopping paper sheet transportation inside the image forming apparatus 2.

The UI controller 204, which functions as one example of a display, controls the UI, thereby displaying information on the UI, and erasing (clearing) displayed information.

Note that each of the above-mentioned controller 100 and controller 2C includes a central processing unit (CPU), a read only memory (ROM) and a random access memory (RAM) in practice.

Thereby, the above functions are realized by causing the CPU to execute processing while exchanging data with the RAM in accordance with a program stored in the ROM.

Next, processing performed by the controller 100 and processing performed by the controller 2C in a case where a jam occurs in the paper sheet processor 3 will be described more specifically.

Figure 5:
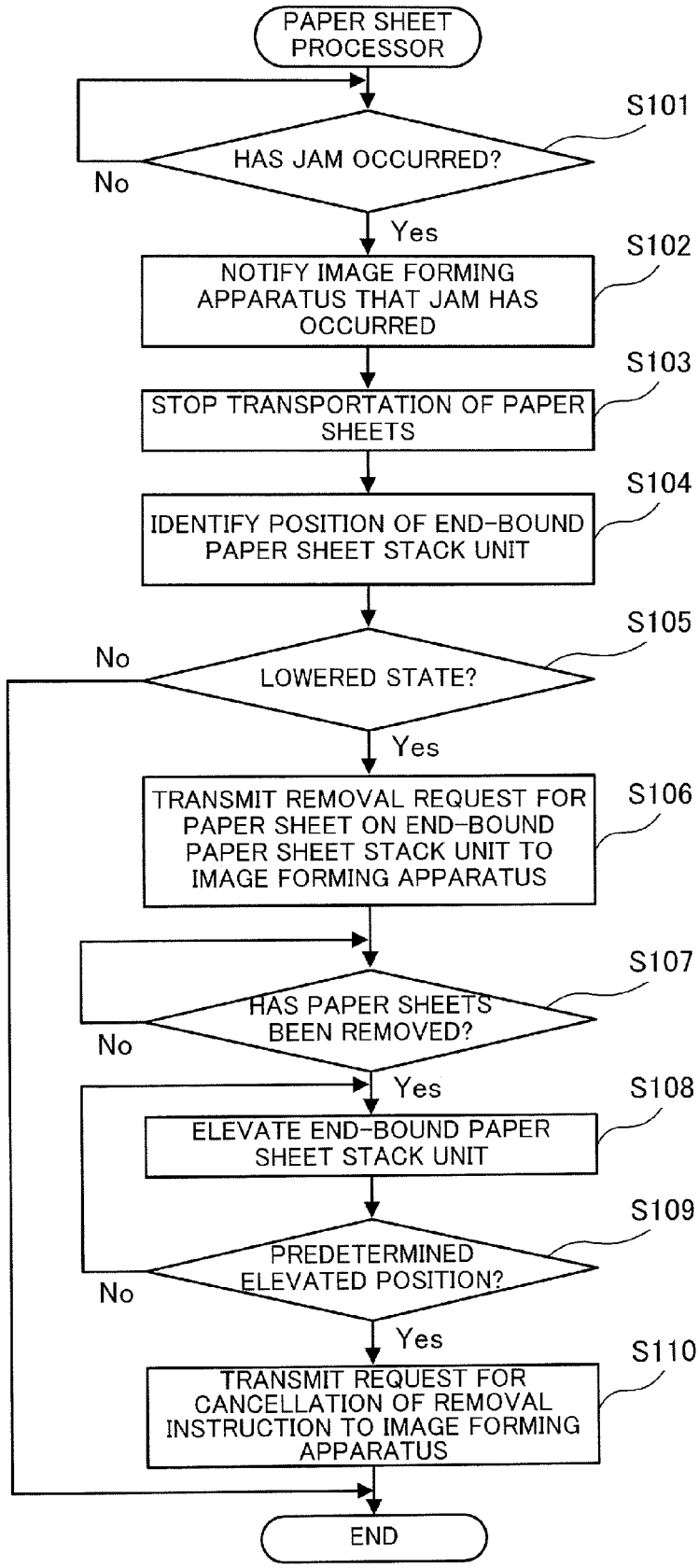
FIG. 5 is a flowchart showing one example of a procedure of the processing performed by the controller in the paper sheet processor.

FIG. 5 is a flowchart showing one example of a procedure of the processing performed by the controller 100 in the paper sheet processor 3.

As shown in FIG. 5, the jam detector 101 in the controller 100 monitors outputs from the jam detecting sensors S4, and determines whether or not a jam of paper sheets (a paper sheet bundle) has occurred in the transporting route and the like in the second post-processing apparatus 50 (step 101). Note that, if it is determined that a jam has not occurred, the processing returns to step 101. Then, if it is determined in step 101 that a jam has occurred, the transmitter 103 notifies the image forming apparatus 2 that a jam has occurred in the paper sheet processor 3 (step 102). Subsequently, the paper sheet transportation controller 102 stops the drive motor (not shown in the figure) and the like, thereby stopping transportation of paper sheets (step 103). Thereafter, the paper sheet stack controller 104 identifies a position of the end-bound paper sheet stack unit 45 on the basis of outputs from the position detecting sensors S2 (step 104).

Subsequently, the paper sheet stack controller 104 determines whether or not the end-bound paper sheet stack unit 45 is in the lowered state (step 105). In more detailed description, the paper sheet stack controller 104 determines, on the basis of outputs from the position detecting sensors S2, whether or not the end-bound paper sheet stack unit 45 is positioned lower than the predetermined position. Note that, if it is determined in step 105 that the end-bound paper sheet stack unit 45 is not in the lowered state, that is, if the end-bound paper sheet stack unit 45 is positioned sufficiently high to the extent allowing the first cover member 50B to be opened, the processing is finished.

On the other hand, if it is determined in step 105 that the end-bound paper sheet stack unit 45 is in the lowered state, the transmitter 103 transmits, to the image forming apparatus 2, a removal request for paper sheets stacked on the end-bound paper sheet stack unit 45 (step 106). Thereby, in the present exemplary embodiment, a removal instruction for paper sheets stacked on the end-bound paper sheet stack unit 45 is displayed on the UI in the image forming apparatus 2 (details of the display will be described later). Note that the present exemplary embodiment employs a configuration in which the removal request for paper sheets is thus transmitted to the image forming apparatus 2, but may employ instead, for example, another configuration in which the end-bound paper sheet stack unit 45 transmits, to the image forming apparatus 2, a notification that the end-bound paper sheet stack unit 45 is in the lowered state.

Subsequently, on the basis of outputs from the presence/absence detecting sensor S1, the paper sheet stack controller 104 determines whether or not paper sheets on the end-bound paper sheet stack unit 45 have been removed (step 107). Note that, if it is determined that paper sheets on the end-bound paper sheet stack unit 45 have not been removed in the step 107, processing of step 107 is executed again. On the other hand, if it is determined that paper sheets on the end-bound paper sheet stack unit 45 have been removed, the paper sheet stack controller 104 drives the motor M, thereby elevating the end-bound paper sheet stack unit 45 (step 108). Then, on the basis of outputs from the position detecting sensors S2, the paper sheet stack controller 104 determines whether or not the end-bound paper sheet stack unit 45 has reached a predetermined elevated position (step 109). Note that, if the end-bound paper sheet stack unit 45 has not yet reached the predetermined elevated position, the paper sheet stack controller 104 further elevates the end-bound paper sheet stack unit 45 (step 108). On the other hand, if it is determined in step 109 that the end-bound paper sheet stack unit 45 has reached the predetermined elevated position, the transmitter 103 transmits, to the image forming apparatus 2, a request for cancellation of the above-mentioned removal instruction displayed on the UI (step 110), and the processing is finished.

Next, the processing performed by the controller 2C in the image forming apparatus 2 will be described.

Figure 6:
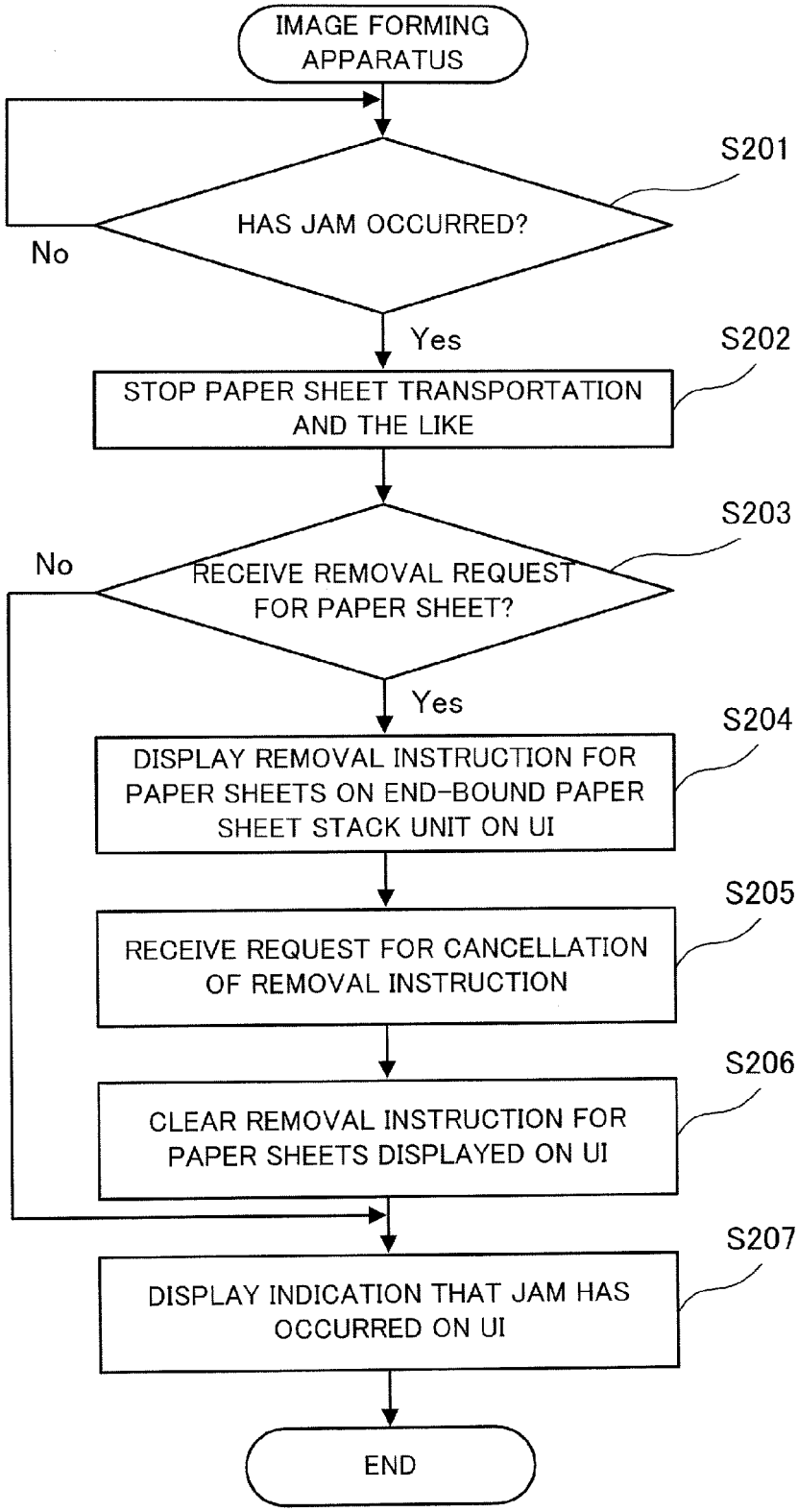
FIG. 6 is a flowchart showing one example of a procedure of the processing performed by the controller in the image forming apparatus.

FIG. 6 is a flowchart showing one example of a procedure of the processing performed by the controller 2C in the image forming apparatus 2.

First of all, the jam detector 202 in the controller 2C determines, on the basis of information transmitted from the paper sheet processor 3 side and received by the receiver 201, whether or not a jam has occurred in the paper sheet processor 3 (step 201). Then, if it is determined in step 201 that a jam has occurred, the paper sheet transportation controller 203 controls the paper sheet transporting mechanism in the image forming apparatus 2 and the like, thereby stopping paper sheet transportation and the like inside the image forming apparatus 2 (step 202).

Thereafter, the controller 2C determines whether or not the receiver 201 has received, from the paper sheet processor 3, the removal request for paper sheets stacked on the end-bound paper sheet stack unit 45 (step 203). Note that, if the receiver 201 has not received the removal request within a predetermined time period, the processing proceeds to step 207. On the other hand, if it is determined in step 203 that the receiver 201 has received the removal request, the UI controller 204 displays, on the UI, a removal instruction (a removal request) for paper sheets on the end-bound paper sheet stack unit 45 (step 204). This allows the operator to be urged to remove paper sheets on the end-bound paper sheet stack unit 45, and the operator having seen the UI removes the paper sheets on the end-bound paper sheet stack unit 45.

Subsequently, when the receiver 201 receives a request for cancellation of the removal instruction (step 205), the UI controller 204 clears the removal instruction for paper sheets displayed in step 204 on the UI (step 206), the request being transmitted from the transmitter 103 of the paper sheet processor 3. Thereafter, the UI controller 204 displays, on the UI, an indication that a jam has occurred in the paper sheet processor 3 (step 207), and the processing is finished.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing system comprising:

an image forming unit that forms an image on a sheet;

a sheet stack unit that lowers along a moving route set in advance, as more sheets are stacked on the sheet stack unit, the sheets each having an image formed thereon by the image forming unit, the sheets being transported through a first transporting route;

a processing unit that is provided in a housing, and that applies processing to a sheet having an image formed thereon by the image forming unit, the sheet being transported through a second transporting route;

a cover member that is provided so that a part of the housing is openable, that partially reaches a position in the moving route when the part of the housing is opened, and that allows a user to operate the processing unit by opening the part of the housing;

a jam detecting unit that detects an abnormality in transportation of sheets;

a position identifying unit that identifies a position of the sheet stack unit in an up and down direction along the moving route when the abnormality in transportation has been detected;

a sheet detecting unit that detects absence of sheets on the sheet stack unit upon detection of the abnormality by the jam detecting unit, and when the position of the sheet stack unit is identified in a position where the sheet stack unit interferes with the cover member; and a moving unit that moves the sheet stack unit to a position where the sheet stack unit does not interfere with the cover member, when the sheet detecting unit detects absence of sheets on the sheet stack unit.

2. The sheet processing system according to claim 1, further comprising a display through which a user is urged to remove sheets from the sheet stack unit.

3. The sheet processing system according to claim 1, further comprising a display showing that the abnormality in the transportation of the sheet has occurred, wherein the moving unit moves the sheet stack unit to the position where the sheet stack unit does not interfere with the cover member, when sheets stacked on the sheet stack unit are removed, and the display shows that the abnormality in the transportation has occurred, after the sheets stacked on the sheet stack unit are removed.

4. A sheet processor comprising:

a sheet stack unit that lowers along a moving route set in advance, as more sheets are stacked on the sheet stack unit, the sheets each having an image formed thereon by an image forming apparatus, and the sheets being transported through a first transporting route;

a processing unit that is provided in a housing, and that applies processing to a sheet having an image formed thereon by the image forming apparatus, the sheet being transported through a second transporting route;

a cover member that is provided so that a part of the housing is openable, that partially reaches a position in the moving route when the part of the housing is opened, and allows a user to operate the processing unit by opening the part of the housing;

a jam detecting unit that detects an abnormality in transportation of sheets;

a position identifying unit that identifies a position of the sheet stack unit in an up and down direction along the moving route when the abnormality in transportation has been detected;

a sheet detecting unit that detects absence of sheets on the sheet stack unit upon detection of the abnormality by the jam detecting unit, and when the position of the sheet stack unit is identified in a position where the sheet stack unit interferes with the cover member; and a moving unit that moves the sheet stack unit to a position where the sheet stack unit does not interfere with the cover member, when the sheet detecting unit detects absence of sheets on the sheet stack unit.

5. The sheet processor according to claim 4, further comprising a transmitting unit that transmits information to the image forming apparatus, the information being used for causing the image forming apparatus to perform a display for urging a user to remove sheets from the sheet stack unit.

6. The sheet processor according to claim 4, wherein the moving unit moves the sheet stack unit to the position where the sheet stack unit does not interfere with the cover member, when sheets stacked on the sheet stack unit are removed, and the sheet processor further comprises a transmitting unit that transmits information to the image forming apparatus after the sheets stacked on the sheet stack unit are removed, the information being used for causing the image forming apparatus to perform a display showing that the abnormality in transportation has occurred.

7. An abnormal-transportation correction method of a sheet processor including a sheet stack unit that lowers along a moving route set in advance, as more sheets are stacked on the sheet stack unit, the sheets each having an image formed thereon, and the sheets being transported through a first transporting route; a processing unit that is provided in a housing, and that applies processing to a sheet having an image formed thereon, the sheet being transported through a second transporting route; and a cover member that is provided so that a part of the housing is openable, that partially reaches a position in the moving route when the part of the housing is opened, and allows a user to operate the processing unit by opening the part of the housing, the abnormal-transportation correction method comprising:

detecting an abnormality in transportation of sheets;

detecting absence of sheets on the sheet stack unit upon detection of the abnormality;

identifying a position of the sheet stack unit in an up and down direction along the moving route when the abnormality in transportation has been detected;

detecting absence of sheets on the sheet stack unit when the position of the sheet stack unit is identified in a position where the sheet stack unit interferes with the cover member; and moving the sheet stack unit to a position where the sheet stack unit does not interfere with the cover member, upon occurrence of an abnormality in transportation of sheets.

* * * * *